US010980307B2

(12) United States Patent
Stade

(10) Patent No.: US 10,980,307 B2
(45) Date of Patent: Apr. 20, 2021

(54) HELMET SYSTEM

(71) Applicant: Thomas M. Stade, Ocean Springs, MS (US)

(72) Inventor: Thomas M. Stade, Ocean Springs, MS (US)

( * ) Notice: Subject to any disclaimer, the term of this patent is extended or adjusted under 35 U.S.C. 154(b) by 303 days.

(21) Appl. No.: 16/101,765

(22) Filed: Aug. 13, 2018

(65) Prior Publication Data

US 2019/0045871 A1 Feb. 14, 2019

Related U.S. Application Data

(60) Provisional application No. 62/605,437, filed on Aug. 14, 2017.

(51) Int. Cl.

| | |
|---|---|
| ***A42B 3/14*** | (2006.01) |
| ***A42B 3/04*** | (2006.01) |
| *A41D 13/05* | (2006.01) |

(52) U.S. Cl.

CPC ..... *A42B 3/142* (2013.01); *A42B 3/0473* (2013.01); *A42B 3/145* (2013.01); *A41D 13/0512* (2013.01)

(58) Field of Classification Search

CPC ..... A42B 3/142; A42B 3/0473; A42B 3/145; A42B 3/0512; A41D 13/0512

See application file for complete search history.

(56) References Cited

U.S. PATENT DOCUMENTS 2,150,290 A 3/1939 Mulvey
2,769,176 A * 11/1956 Grancsay ..... A42B 3/085 2/421
3,039,108 A * 6/1962 Lohrenz ..... A42B 3/10 2/412
3,103,014 A * 9/1963 Morgan ..... A42B 3/10 2/415
3,174,155 A * 3/1965 Pitman ..... A42B 3/20 2/411
3,241,154 A * 3/1966 Aileo ..... A42B 3/10 2/419
3,242,500 A * 3/1966 Derr ..... A42B 3/069 2/412
3,388,405 A * 6/1968 Simpson ..... A42B 3/142 2/418
3,462,763 A * 8/1969 Schneider ..... A42B 3/12 2/413
3,471,866 A * 10/1969 Raney ..... A42B 3/14 2/418
3,591,863 A * 7/1971 Rickard ..... A42B 3/085 2/415
3,751,728 A 8/1973 Thompkins
3,873,997 A * 4/1975 Gooding ..... A42B 3/0473 2/413

(Continued)

*Primary Examiner* — Richale L Quinn

(74) *Attorney, Agent, or Firm* — Olav M. Underdal; IDP Patent Services

(57) ABSTRACT

A helmet system includes: a helmet shell; right and left bottom guards; a head strap comprising a head band and a plurality of flexible tethers, including a main tether stem and a tether connector, including a connector stem and a connector blocking member, such that the flexible tethers protrude from an outer periphery of the head band and are connected to tether apertures in the helmet shell. The head band can optionally include an opening with a band lock, and right and left upward curved sections. The helmet system can optionally include shoulder pads.

18 Claims, 8 Drawing Sheets

(56) References Cited

U.S. PATENT DOCUMENTS 4,286,339 A * 9/1981 Coombs ..... A42B 3/14 2/414
4,627,114 A * 12/1986 Mitchell ..... A42B 3/128 2/414
5,123,408 A * 6/1992 Gaines ..... A42B 3/0473 2/425
6,314,586 B1 * 11/2001 Duguid ..... A42B 3/069 2/411
6,339,849 B1 1/2002 Nelson et al.
6,560,787 B2 5/2003 Mendoza
8,505,113 B2 * 8/2013 Crye ..... F41H 1/04 2/2.5
8,578,520 B2 * 11/2013 Halldin ..... A42B 3/066 2/411
9,351,529 B1 5/2016 Ashline
9,530,248 B2 12/2016 Zhang et al.
9,603,404 B2 3/2017 Pocatko
9,700,094 B2 * 7/2017 Nagely ..... A42B 3/0473
9,713,355 B2 7/2017 Daoust
9,820,523 B2 * 11/2017 Gaudillere ..... A42B 3/085
9,861,152 B1 1/2018 Rumfelt
9,907,346 B2 * 3/2018 Hanson ..... A42B 3/127
9,924,755 B2 * 3/2018 Margetis ..... A42B 3/0473
9,974,349 B2 * 5/2018 Gotti ..... A42B 3/085
10,016,006 B2 * 7/2018 Popejoy ..... A42B 3/064
10,039,337 B2 * 8/2018 Heath ..... A42B 3/085
10,178,888 B2 * 1/2019 Wetzel ..... A63B 71/10
10,244,811 B2 * 4/2019 Xiong ..... A42B 3/147
10,653,201 B2 * 5/2020 Margetis ..... A42B 3/046
2006/0206994 A1 * 9/2006 Rogers ..... A42B 3/145 2/418
2008/0256684 A1 * 10/2008 Ashline ..... A42B 3/0406 2/411
2012/0222197 A1 * 9/2012 Nagely ..... A42B 3/0473 2/410
2014/0028243 A1 * 1/2014 Rayner ..... F16M 11/14 320/103
2014/0090156 A1 * 4/2014 Tom ..... A42B 3/0473 2/421
2014/0109301 A1 * 4/2014 Hall ..... A42B 3/142 2/416
2014/0157498 A1 * 6/2014 Bird ..... A42B 3/0473 2/459
2014/0259309 A1 * 9/2014 Pettersen ..... A42B 3/069 2/411
2015/0000013 A1 * 1/2015 Pettersen ..... A42B 3/069 2/411
2015/0201723 A1 * 7/2015 Rayner ..... A45C 13/008 224/191
2015/0282760 A1 * 10/2015 Badower ..... A61B 5/6803 600/383
2016/0157543 A1 * 6/2016 Huang ..... A61B 5/11 2/411
2016/0249702 A1 9/2016 Pfanner et al.
2016/0325645 A1 * 11/2016 Hansen ..... A42B 3/0406
2017/0127747 A1 * 5/2017 Thalken ..... A63B 71/10
2017/0150767 A1 * 6/2017 Wetzel ..... A63B 71/10
2017/0245576 A1 * 8/2017 Hetzler ..... A42B 3/0473
2017/0303620 A1 * 10/2017 Sicking ..... A42B 3/064
2017/0309152 A1 * 10/2017 Dinkins ..... G08B 21/0461
2018/0028091 A1 * 2/2018 Huang ..... A61F 5/3707
2018/0077995 A1 3/2018 Dutour
2018/0168910 A1 * 6/2018 Threlfall ..... A61H 3/008
2019/0045871 A1 * 2/2019 Stade ..... A42B 3/145
2019/0054363 A1 * 2/2019 Metts ..... A42B 3/121
2020/0022443 A1 * 1/2020 Wetzel ..... A42B 3/064
2020/0253315 A1 * 8/2020 Maloney ..... A42B 3/145

* cited by examiner

Helmet System

HELMET SYSTEM

CROSS-REFERENCE TO RELATED APPLICATIONS

This application claims the benefit of U.S. Provisional Application No. 62/605,437, filed Aug. 14, 2017; which is hereby incorporated herein by reference in its entirety.

FIELD OF THE INVENTION

The present invention relates generally to the field of safety of equipment for humans, and more particularly to methods and systems for helmet systems that protect the head of a human.

BACKGROUND OF THE INVENTION

Helmets are used in a number of areas to protect the head of humans on work sites and during sports activities.

However, conventional helmet designs rely on padding that establishes a large contact area with the head, and while they may aid in preventing blunt force trauma from direct impact, are generally not effective in preventing head movement and as such may not prevent brain injuries caused by sudden movement of the head.

As such, considering the foregoing, it may be appreciated that there continues to be a need for novel and improved devices and methods for helmet systems that reduce the risk of injury from head movement.

SUMMARY OF THE INVENTION

The foregoing needs are met, to a great extent, by the present invention, wherein in aspects of this invention, enhancements are provided to the existing model of helmet systems.

In an aspect, a helmet system can include:

a) a helmet shell; and b) a head strap, which can include:

i. a head band, which encircles a head of a user, such that the head band is stably and removably attached to the head;

ii. a plurality of flexible tethers, such that each flexible tether is connected in an inner end to an outer periphery of the head band and protrudes outward from the head band, such that an outer end of the corresponding flexible tether is connected to an inner surface of the helmet shell.

In a related aspect, the helmet system can further include right and left bottom guards, which are mounted to respectively right and left bottom ends of the helmet shell, such that the helmet system when worn by the user is configured with shoulder separation distances between lowest points of respectively the right and left bottom guards and a top of a shoulders or shoulder pads worn by the user, that are smaller than a head separation distance between a top inner point of the helmet shell and a top of the head of the user, whereby the right and left bottom guards prevent the head from impacting with the helmet shell.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
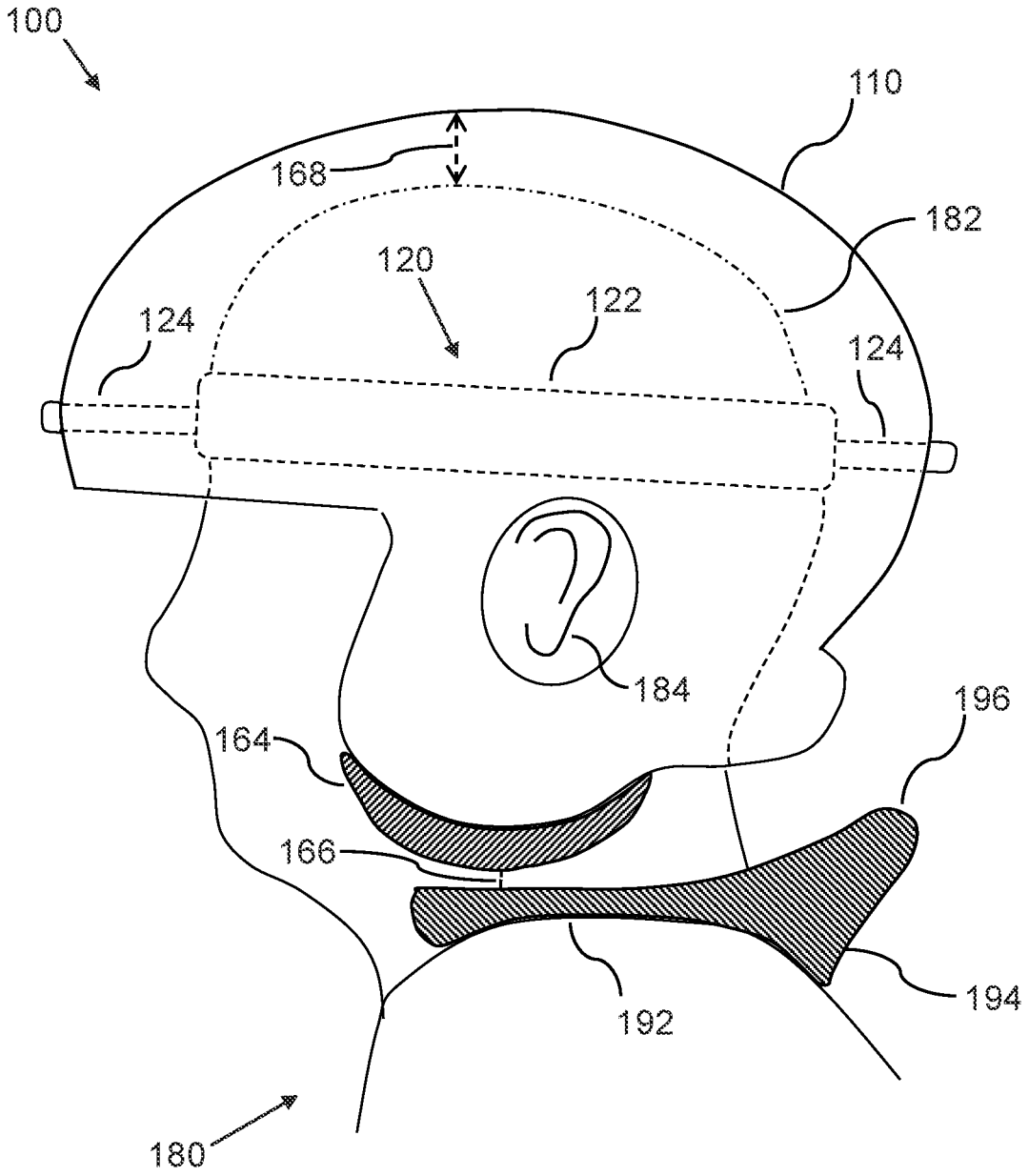
FIG. 1 is a side view of a helmet system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a helmet system 100 with reference to FIGS. 1 and 2, in such manner that like reference numerals refer to like components throughout; a convention that we shall employ for the remainder of this specification.

Figure 2:
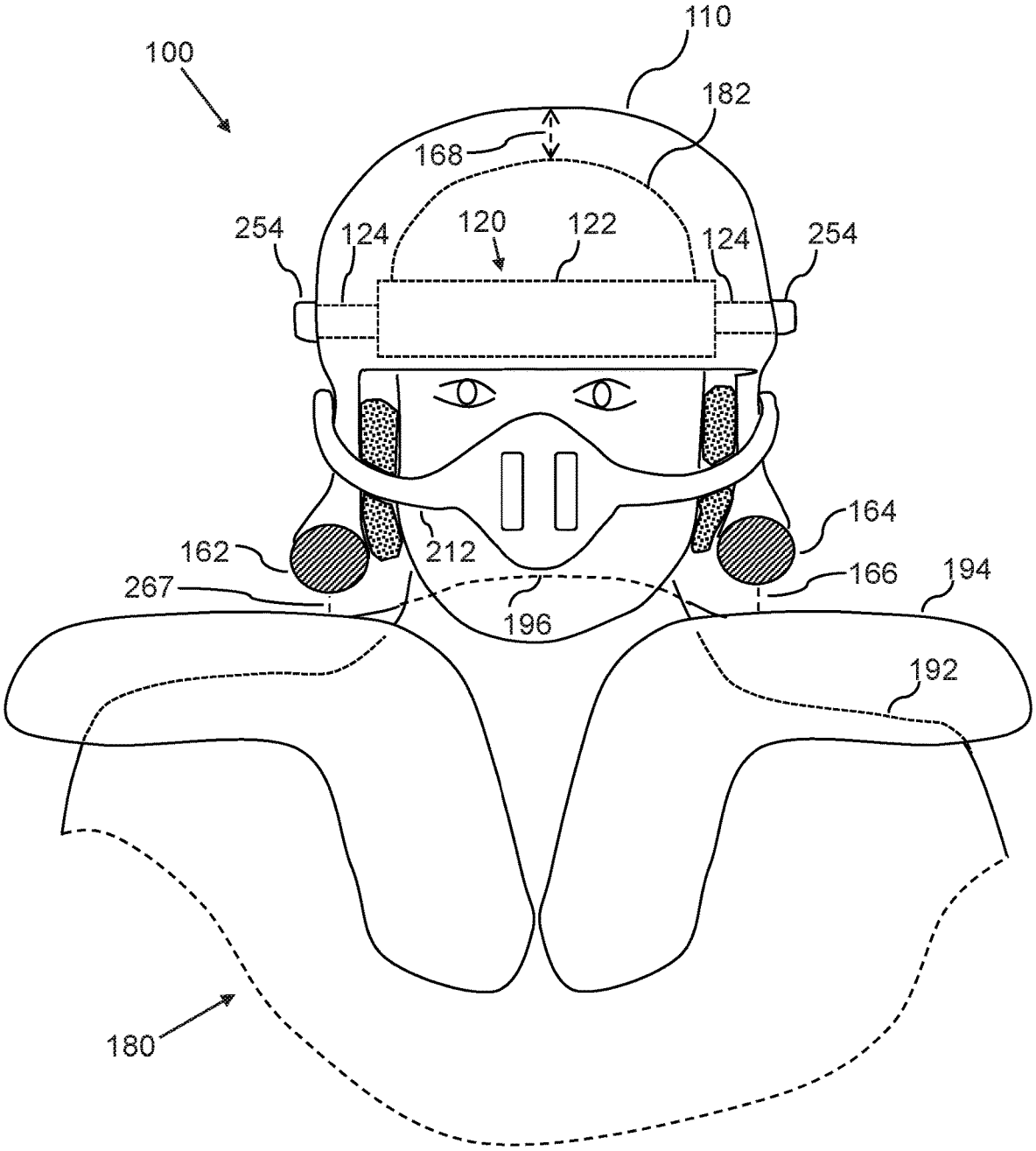
FIG. 2 is a front view of a helmet system, according to an embodiment of the invention.

In an embodiment, as shown in FIGS. 1 and 2, a helmet system 100 can include:

a) a helmet shell 110; and b) a head strap 120, which can include:

i. a head band 122, which is configured to encircle a head 182 of a user 180, such that head band 122 is stably and removably attached to the head 182; and ii. a plurality of flexible tethers 124, such that each corresponding flexible tether 124 is connected in an inner end to an outer periphery of the head band 122 and protrudes outward from the head band 122, such that an outer end of the corresponding flexible tether 124 is connected to an inner surface of the helmet shell 110.

In a related embodiment, as shown in FIGS. 1 and 2, the helmet system 100 can further include right and left bottom guards 162 164, which are mounted to respectively right and left bottom ends of the helmet shell 110, such that the helmet system 100 when worn by the user 180 is configured with shoulder separation distances 166 between lowest points of respectively the right and left bottom guards and a top of a shoulder 192, which can include a top of shoulder pads 194 worn by the user 180, that are smaller than a head separation distance 168 between a top inner point of the helmet shell 110 and a top of the head of the user, whereby the plurality of flexible tethers 124 and the right and left bottom guards prevent the head from impacting with the helmet shell 110, whereby the helmet system 100 and shoulder pads 194 work together to stop the impact energy from going to the head 182 and brain.

In a further related embodiment, as shown in FIGS. 1 and 2, the helmet system 100 can further include:

right and left bottom guards 162 164, which are mounted to respectively right and left bottom ends of the helmet shell 110;

such that the helmet system 100 when worn by the user 180 is configured with right and left shoulder separation distances 267 166 between lowest points of respectively the right and left bottom guards 162 164 and tops of respectively right and left sides of the shoulder pads 194, that are smaller than a head separation distance 168 between a top inner point of the helmet shell 110 and a top of the head 182 of the user 180, whereby the plurality of flexible tethers 124 and the right and left bottom guards 162 164 prevent the head 182 from impacting with the helmet shell 110, whereby the helmet system 100 and shoulder pads 194 work together to stop the impact energy from going to the head 182 and brain.

In a further related embodiment, as shown in FIGS. 1 and 2, the shoulder pads 194 can further comprise a neck guard 196, which is an upward protrusion on a back of the should pads, such that the neck guard 196 can be molded to the shoulder pads 194, as a part of the shoulder pads 194 and can be made out of a hard rubber material.

In related embodiments, the helmet system 100 can be configured for use with any contact, action, and/or extreme sport, including American football, soccer, ice hockey, ski racing, motor racing, etc.

Figure 3A:
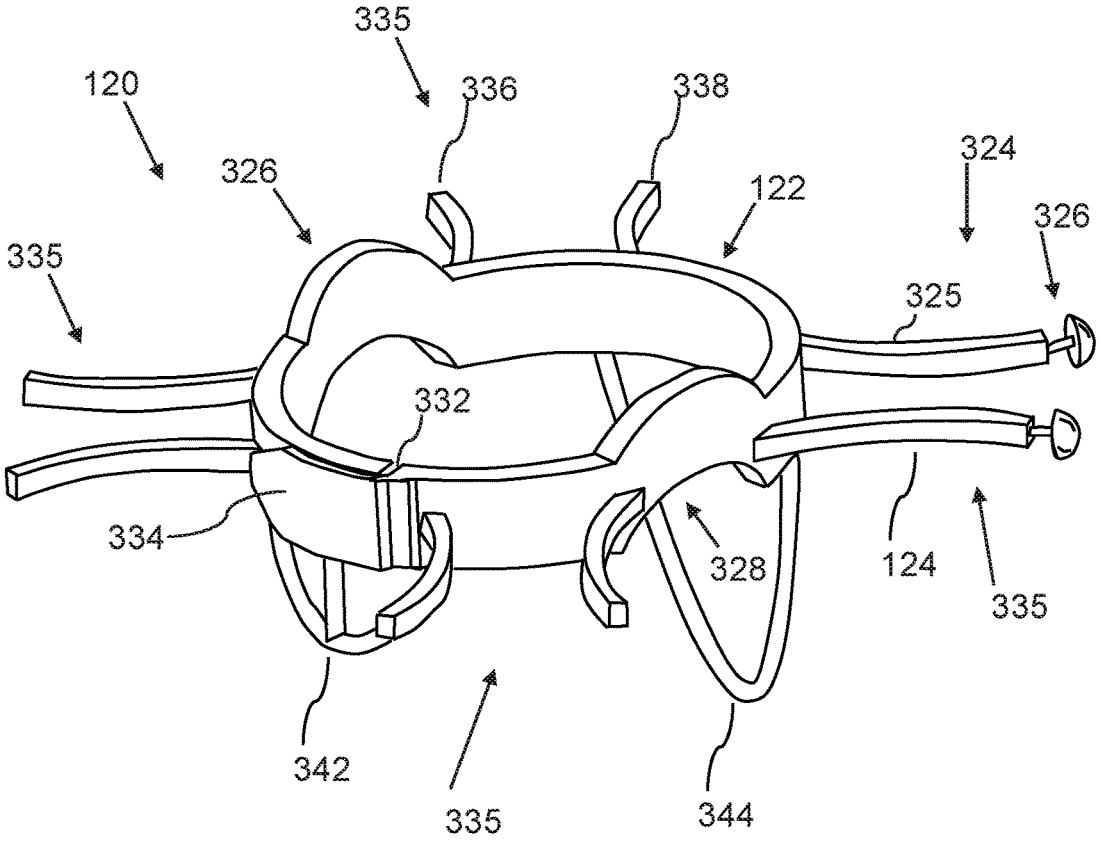
FIG. 3A is a perspective view of a head strap of a helmet system, according to an embodiment of the invention.
Figure 3B:
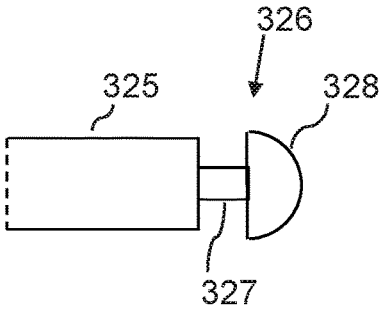
FIG. 3B is a side view of a tether connector on an outer end of a flexible tether, according to an embodiment of the invention.
Figure 3C:
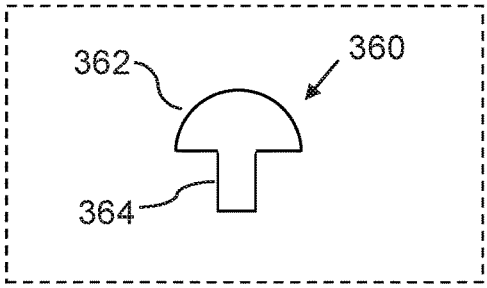
FIG. 3C is a side view of a helmet shell with a tether aperture, according to an embodiment of the invention.
Figure 3D:
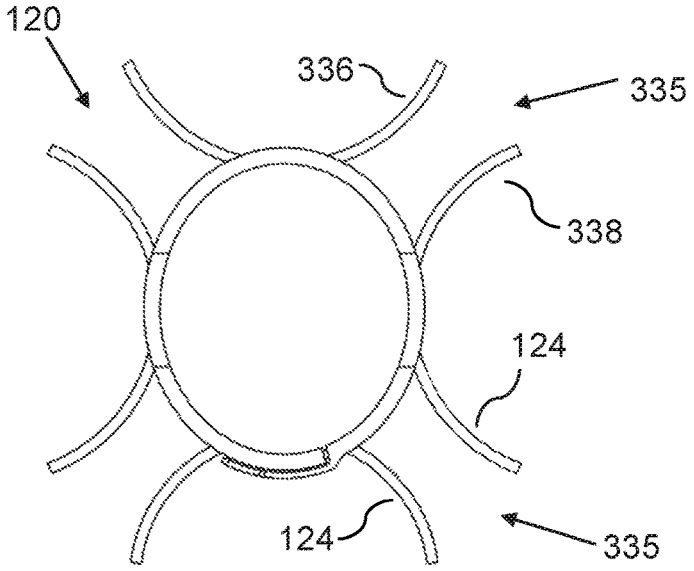
FIG. 3D is a top view of a head strap of a helmet system, according to an embodiment of the invention.

In a related embodiment, as shown in FIGS. 3A and 3D, the flexible tethers 124 can be curved, for example with a circular (as shown), elliptical, or parabolical curve. As shown the flexible tethers 124 can have a rectangular cross-sectional shape, or alternatively have a circular cross-sectional shape or other cross-sectional shape.

In a related embodiment, as shown in FIGS. 4A, 4B, 4C, and 4D, showing an alternative head strap 420, the flexible tethers 424 can be straight. As shown, the flexible tethers 424 can have a rectangular cross-sectional shape, or alternatively have a circular cross-sectional shape or other cross-sectional shape.

In a related embodiment, as shown in FIG. 3A, the curved flexible tethers 124 can configured in tether pairs 335 of two adjacent opposedly curved flexible tethers 336 338, which are configured with opposing convex curves that curve away from each in outer ends of the opposedly curved flexible tethers 336 338. As shown, the head strap 120 can be configured with four tether pairs 335, each including two adjacent opposedly curved flexible tethers 336 338, positioned on respectively front right, front left, rear right, and rear left sides of the head band 122.

Figure 4A:
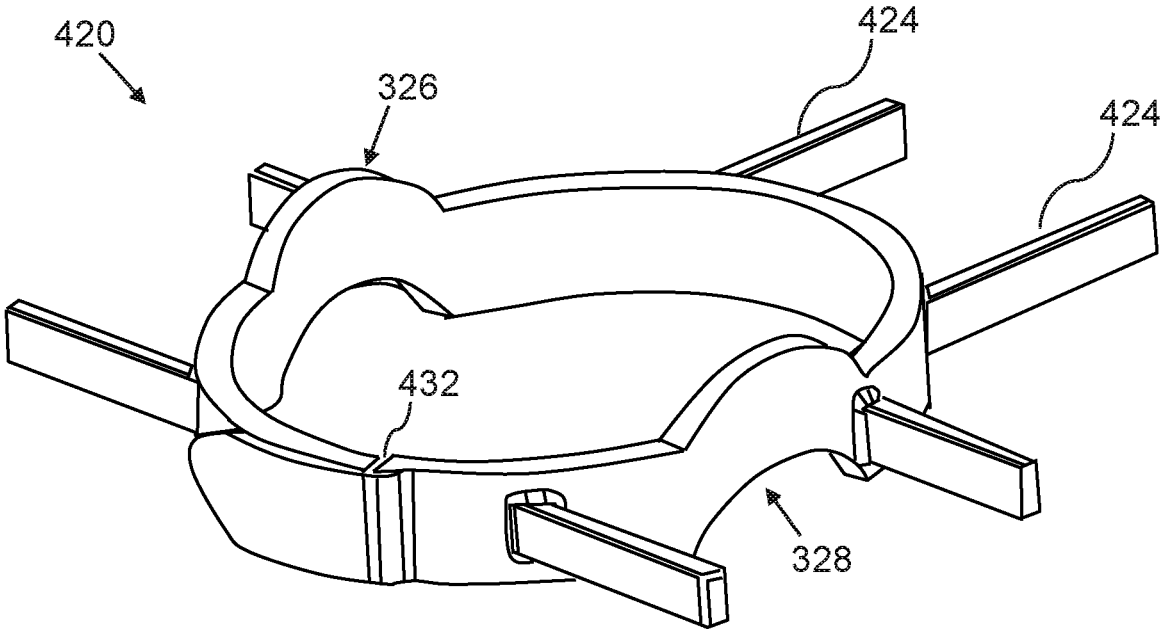
FIG. 4A is a perspective view of a head strap of a helmet system, according to an embodiment of the invention.
Figure 4B:
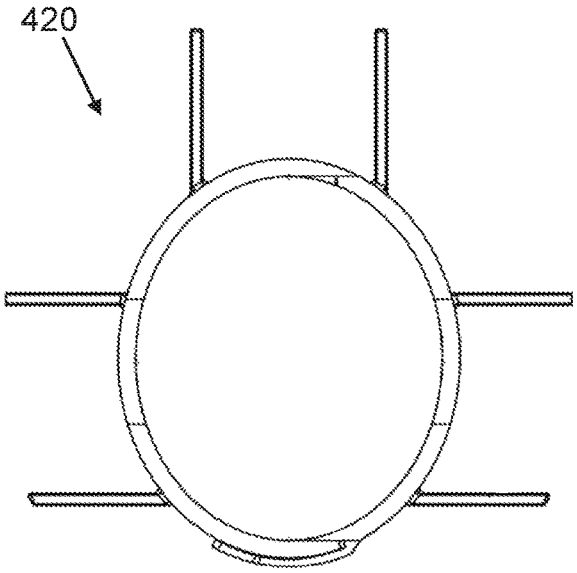
FIG. 4B is a top view of a head strap of a helmet system, according to an embodiment of the invention.
Figure 4D:
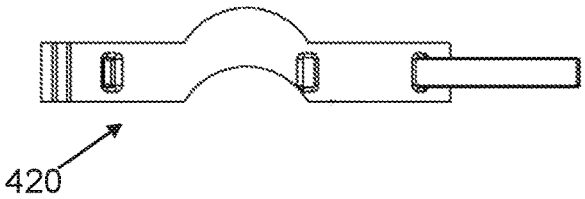
FIG. 4D is a side view of a head strap of a helmet system, according to an embodiment of the invention.
Figure 4C:
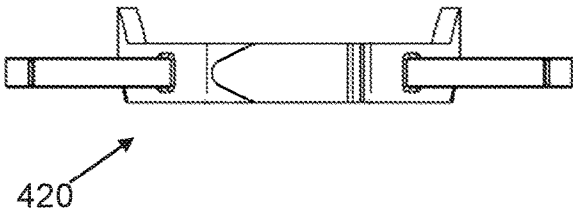
FIG. 4C is a front view of a head strap of a helmet system, according to an embodiment of the invention.

In a related embodiment, as shown in FIGS. 3A and 4A, the head band 122 can include right and left upward curved sections 326 328 on respectively right and left sides of the head band 122, in order to provide space for respectively right and left ears 184 of the user 180.

In a related embodiment, as shown in FIG. 2, outer ends of each flexible tether 124 can include a tether connector 254 that connects the corresponding flexible tether 124 with the helmet shell 110.

In a further related embodiment, as shown in FIGS. 3A, 3B, 3C, and 6B, a flexible tether 324 can include:

a) a main tether stem 325; and b) a tether connector 326, which is connected to an outer end of the main tether stem 325, the tether connector 326 including:

i. a connector stem 327, which is connected in an inner end to the main tether stem 325; and ii. a connector blocking member 328, which is connected to an outer end of the main tether stem 325. The connector blocking member 328 can be semi-spherical;

wherein the connector stem 327 is thinner (i.e. has smaller diameter) than the main tether stem 325 and the connector blocking member 328;

wherein the helmet shell 110 610 includes a tether aperture 360, which includes a blocking member opening 362 that can be a half-circle, and a stem opening 364, which can be connected to a diameter side of the half-circle shape of the blocking member opening 362;

wherein the connector blocking member is insertable through the blocking member opening 362, such that the connector stem 327 slides into and through the stem opening 364 (in a sideways orientation, by flexing the outer end of the flexible tether 324);

such that the connector blocking member 328 locks in place on an outer side of the helmet shell 110 610, such that the flexible tether 324 is removably connected to the helmet shell 110 610.

In a related embodiment, as shown in FIG. 2, the helmet system 100 can further include a lower face protector 212, which can be an integral part of the helmet shell 110 or be connected to the helmet shell 110.

In other related embodiments, outer ends of each flexible tether 124 can be glued or fused to the helmet shell.

In a related embodiment, as shown in FIGS. 3A and 4A, the head band 122 can be configured with an opening 332 432 that can be closed with a band lock 334, such as a clasp 334 or overlapping piece 334, which can include a hook and loop fastener; wherein the head band 122 comprises a band lock 334, such that the head band 122 is an open band 122 that is closed with the band lock 334.

Figure 3E:
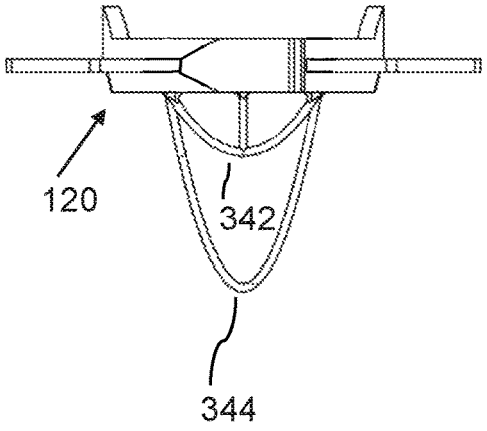
FIG. 3E is a front view of a head strap of a helmet system, according to an embodiment of the invention.
Figure 3F:
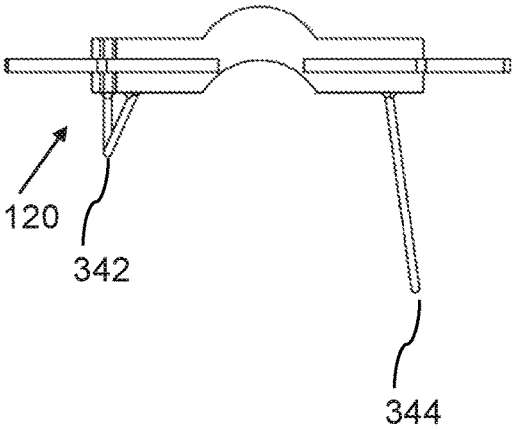
FIG. 3F is a side view of a head strap of a helmet system, according to an embodiment of the invention.

In a related embodiment, as shown in FIGS. 3A, 3E and 3F, the helmet system 100 can include a front pull down piece 342, which is a wire piece or wire/cord loop that is connected to a front of the head band 122, such that the front pull down piece 342 protrudes down, whereby the front pull down piece 342 allows the user 180 to grab the front pull down piece 342, in order to pull down the head band 122, such that it is secured tightly around the head 182 of the user 180.

In a related embodiment, as shown in FIGS. 3A, 3E and 3F, the helmet system 100 can include a rear pull down piece 344, which can be a wire piece or wire/cord loop that is connected to a rear of the head band 122, such that the rear pull down piece 344 protrudes down, whereby the rear pull down piece 344 allows the user 180 to grab the rear pull down piece 344, in order to pull down the head band 122, such that it is secured tightly around the head 182 of the user 180.

In a related embodiment, the head band 122, the flexible tethers 124, and/or the right and left bottom guards 162 164 can be made of a rubber material, including natural rubber and elastomers, including silicone rubber.

In another related embodiment, the head strap 120, including the head band 122 and the flexible tethers 324, each including a tether connector 326, can be manufactured in one piece, as a single unit, for example by injection molding or another type of molding process, or by an additive manufacturing process. Thereby, the helmet shell 110 and the head strap 120 can be connected, forming the helmet system 100, without any need for glue, screws or bolts.

A yet a related embodiment, the head strap 120 can be manufactured in different sizes, such as in small, medium, and large, for example such that the head band 122 is sized in circumference increments of one inch, such as for example with a circumference of 21, 22, and 23 inches for respectively small, medium, and large.

In a related embodiment, the helmet shell 110 can be made of:

a) a plastic material, such as acrylonitrile butadiene styrene or polycarbonate;
b) a fiber material, including glass fiber, carbon fiber, fiberglass composite, fiberglass reinforced with Kevlar or carbon fiber;
c) a composite material, or
d) combinations of plastic, fiber and/or composite materials.

Figure 5A:
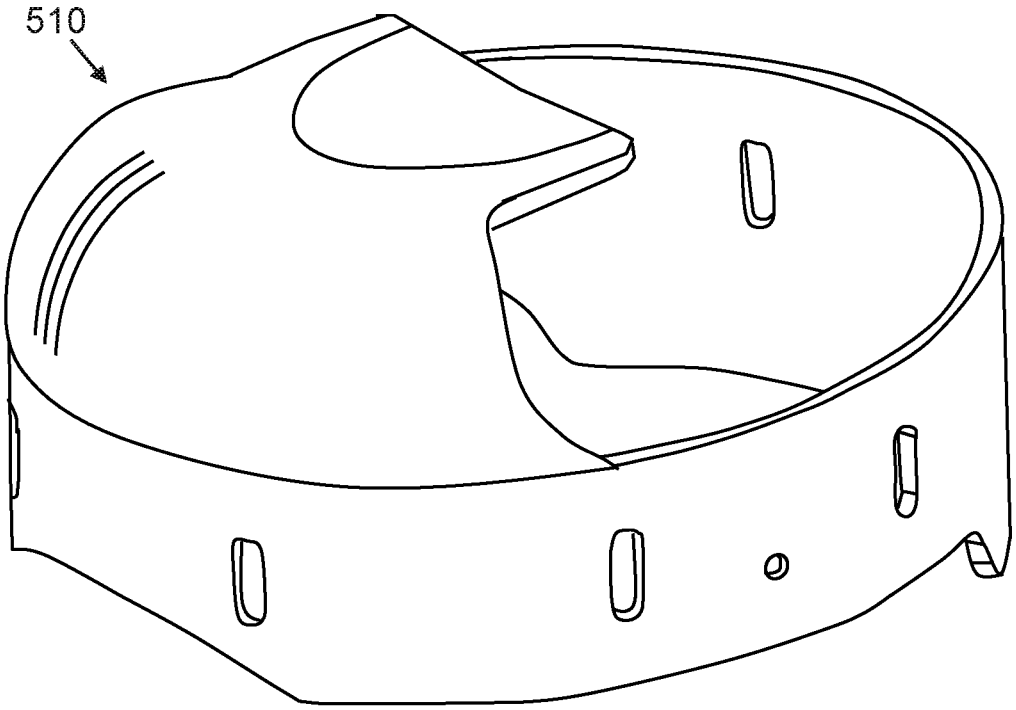
FIG. 5A is a perspective view of a helmet shell of a helmet system, according to an embodiment of the invention.
Figure 5B:
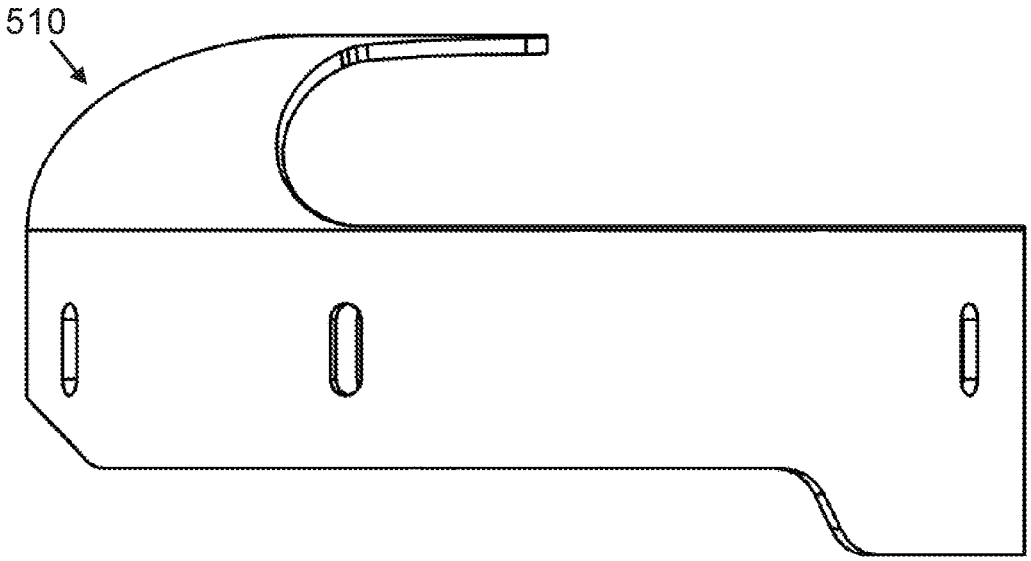
FIG. 5B is a side view of a helmet shell of a helmet system, according to an embodiment of the invention.
Figure 6A:
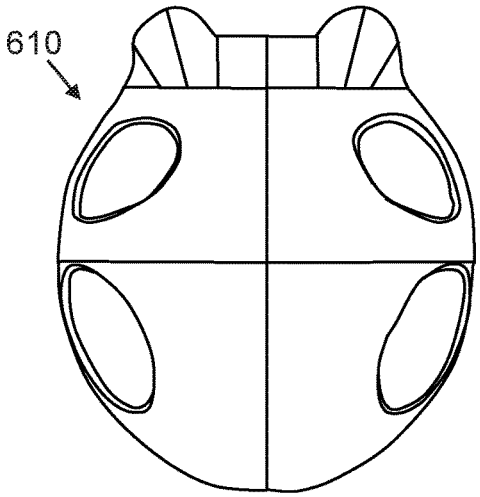
FIG. 6A is a top view of a helmet shell of a helmet system, according to an embodiment of the invention.
Figure 6B:
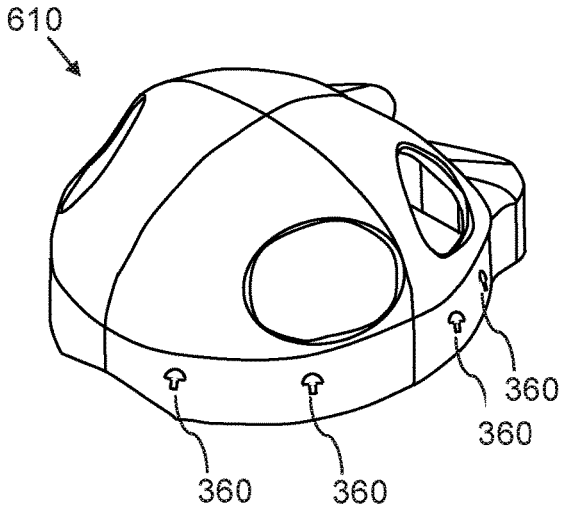
FIG. 6B is a perspective view of a helmet shell of a helmet system, according to an embodiment of the invention.
Figure 6C:
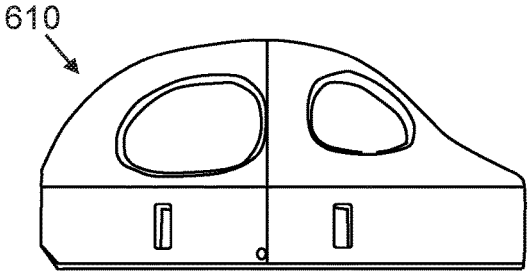
FIG. 6C is a side view of a helmet shell of a helmet system, according to an embodiment of the invention.

In a related embodiment, as shown in FIGS. 5A and 5B, a helmet shell 510 can be designed to only partially cover the head 182 of a user 180.

In a related embodiment, as shown in FIGS. 1, 2, 6A, 6B and 6C, a helmet shell 110 610 can be designed to fully cover at least the upper part of the head 182 of a user 180. The helmet shell 110 610 can include apertures for ventilation.

Thus, in related embodiments, the helmet shell 110 can be configured to float via the flexible connection to the head with plurality of flexible tethers 124, such that the helmet system 100 and the head 182 are in a state of suspension relative to each other, such that when there is a collision, the head, neck and brain of the user 180 are in a state of proportionality, such that there will be no or minimal force applied to the head 182 of the user 180.

Here has thus been described a multitude of embodiments of the helmet system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A helmet system, comprising:

a) a helmet shell;

b) a head strap, comprising:

a head band, which is configured to encircle a head of a user, such that head band is stably and removably attachable to the head of the user; and a plurality of flexible tethers, such that each corresponding flexible tether is connected in an inner end to an outer periphery of the head band and protrudes outward from the head band, such that an outer end of the corresponding flexible tether is connected to an inner surface of the helmet shell;

wherein the corresponding flexible tether further comprises:

a main tether stem; and a tether connector, which is connected to an outer end of the main tether stem, the tether connector comprising:

a connector stem, which is connected in an inner end to the main tether stem; and a connector blocking member, which is connected to an outer end of the main tether stem;

wherein the connector stem is thinner than the main tether stem and the connector blocking member;

wherein the helmet shell comprises a tether aperture, which comprises a blocking member opening and a stem opening;

such that the connector blocking member is insertable through the blocking member opening, such that the connector stem slides into and through the stem opening;

such that the connector blocking member locks in place on an outer side of the helmet shell, such that the corresponding flexible tether is removably connected to the helmet shell.

2. The helmet system of claim 1, further comprising:

right and left bottom guards, which are mounted to respectively right and left bottom ends of the helmet shell;

such that the helmet system when worn by the user is configured with shoulder separation distances between lowest points of respectively the right and left bottom guards and a top of a shoulder of the user, that are smaller than a head separation distance between a top inner point of the helmet shell and a top of the head of the user, whereby the right and left bottom guards prevent the head from impacting with the helmet shell.

3. The helmet system of claim 1, wherein the flexible tethers are curved.

4. The helmet system of claim 3, wherein the flexible tethers comprise at least one pair of two adjacent opposedly curved flexible tethers, which are configured with opposing convex curves that curve away from each in outer ends of the opposedly curved flexible tethers.

5. The helmet system of claim 4, wherein the head strap comprises four tether pairs, each including two adjacent opposedly curved flexible tethers, positioned on respectively front right, front left, rear right, and rear left sides of the head band.

6. The helmet system of claim 1, wherein the head band further comprises:

right and left upward curved sections on respectively right and left sides of the head band, such that the right and left upward curved sections provide space for respectively right and left ears of the user.

7. The helmet system of claim 1, wherein the head band comprises a band lock, such that the head band is an open band that is closed with the band lock.

8. The helmet system of claim 1, further comprising a front pull down piece, which is connected to a front of the head band, such that the front pull down piece protrudes down, whereby the front pull down piece allows the user to grab the front pull down piece, in order to pull down the head band, such that it is secured tightly around the head of the user.

9. The helmet system of claim 1, further comprising a rear pull down piece, which is connected to a rear of the head band, such that the rear pull down piece protrudes down, whereby the rear pull down piece allows the user to grab the rear pull down piece in order to pull down the head band, such that it is secured tightly around the head of the user.

10. The helmet system of claim 1, wherein the flexible tethers are made of a rubber material.

11. The helmet system of claim 1, wherein the helmet shell is made of a plastic material.

12. A helmet system, comprising:

a) a helmet shell; and b) a head strap, comprising:

a head band, which is configured to encircle a head of a user, such that head band is stably and removably attachable to the head of the user;

a plurality of flexible tethers, such that each corresponding flexible tether is connected in an inner end to an outer periphery of the head band and protrudes outward from the head band, such that an outer end of the corresponding flexible tether is connected to an inner surface of the helmet shell; and c) shoulder pads, which are configured to be worn on shoulders of the user;

wherein the corresponding flexible tether further comprises:

a main tether stem; and a tether connector, which is connected to an outer end of the main tether stem, the tether connector comprising:

a connector stem, which is connected in an inner end to the main tether stem; and a connector blocking member, which is connected to an outer end of the main tether stem;

wherein the connector stem is thinner than the main tether stem and the connector blocking member;

wherein the helmet shell comprises a tether aperture, which comprises a blocking member opening and a stem opening;

such that the connector blocking member is insertable through the blocking member opening, such that the connector stem slides into and through the stem opening;

such that the connector blocking member locks in place on an outer side of the helmet shell, such that the corresponding flexible tether is removably connected to the helmet shell.

13. The helmet system of claim 12, further comprising:

right and left bottom guards, which are mounted to respectively right and left bottom ends of the helmet shell;

such that the helmet system when worn by the user is configured with shoulder separation distances between lowest points of respectively the right and left bottom guards and tops of respectively right and left sides of the shoulder pads, that are smaller than a head separation distance between a top inner point of the helmet shell and a top of the head of the user, whereby the right and left bottom guards prevent the head from impacting with the helmet shell.

14. The helmet system of claim 12, wherein the flexible tethers are curved.

15. The helmet system of claim 12, wherein the head band further comprises:

right and left upward curved sections on respectively right and left sides of the head band, such that the right and left upward curved sections provide space for respectively right and left ears of the user.

16. The helmet system of claim 12, wherein the head band comprises a band lock, such that the head band is an open band that is closed with the band lock.

17. The helmet system of claim 12, further comprising a front pull down piece, which is connected to a front of the head band, such that the front pull down piece protrudes down, in order to allow the user to grab the front pull down piece in order to pull down the head band, such that it is secured tightly around the head of the user.

18. The helmet system of claim 12, further comprising a rear pull down piece, which is connected to a rear of the head band, such that the rear pull down piece protrudes down, in order to allow the user to grab the rear pull down piece in order to pull down the head band, such that it is secured tightly around the head of the user.

* * * * *